US005214351A

United States Patent [19]

Nieda

[11] Patent Number: 5,214,351

[45] Date of Patent: May 25, 1993

[54] DISCHARGE TUBE WITH GLOW AND ARC DISCHARGE ELECTRODES

[75] Inventor: Yoriyuki Nieda, Kamakura, Japan

[73] Assignees: Tokyo Densouku Kabushiki Kaisha, Kanagawa; Noritake Co., Limited, Nagoya, both of Japan

[21] Appl. No.: 729,425

[22] Filed: Jul. 12, 1991

[30] Foreign Application Priority Data

Jul. 19, 1990 [JP] Japan ..... 2-191695
Nov. 22, 1990 [JP] Japan ..... 2-318277

[51] Int. Cl.[5] ..... H01J 61/06

[52] U.S. Cl. ..... 313/619; 313/492; 313/622; 313/628; 313/630; 313/631; 313/632

[58] Field of Search ..... 313/619, 633, 631, 622, 313/492, 630, 628, 618, 632

[56] References Cited

U.S. PATENT DOCUMENTS 2,217,438 10/1940 Francis ..... 313/628
2,314,134 3/1943 Eknayan ..... 313/628 X
3,619,699 11/1971 White ..... 313/628
3,849,690 11/1974 Cosco et al. ..... 313/632 X

FOREIGN PATENT DOCUMENTS 30122 3/1980 Japan ..... 313/631
147355 11/1981 Japan .
319769 4/1957 Switzerland .
691959 10/1979 U.S.S.R. ..... 313/631

OTHER PUBLICATIONS

Japanese Patent Abstract, vol. 6, No. 123, (E-117) (1001) Jul. 8, 1982.

*Primary Examiner*—Palmer C. Demeo
*Attorney, Agent, or Firm*—Ladas & Parry

[57] ABSTRACT

A discharge tube includes a pair of electrode devices mounted within a discharge tube body in an opposed relation to each other, each of the pair of electrode devices including an arc discharge electrode and a glow discharge electrode. An electron-radiating substance vaporized and emitted in a scattered manner from the arc discharge electrode is captured by the glow discharge electrode. The arc discharge electrode is composed of a sintered body containing the electron-radiating substance therein.

8 Claims, 3 Drawing Sheets

DISCHARGE TUBE WITH GLOW AND ARC DISCHARGE ELECTRODES

BACKGROUND OF THE INVENTION

This invention relates generally to a discharge tube, and more particularly to the type of discharge tube which includes a pair of electrode devices provided in a discharge space in opposed relation to each other, each of the electrode devices being constituted by an arc discharge electrode and a glow discharge electrode.

The Applicant of the present invention has proposed, in Japanese Patent Application Nos. 1-5753 and 2-124177, discharge tubes of the type in which a pair of electrode devices, each composed of an arc discharge electrode and a glow discharge electrode, are disposed in a discharge space in opposed relation to each other. These discharge tubes are used as a back light lamp for a liquid crystal display device, an illumination fluorescent lamp, or the like. As described above, each of the pair of opposed electrode devices of the discharge tube comprises the arc discharge electrode and the glow discharge electrode, and the two electrodes are disposed adjacent to each other. Thanks to the synergistic effect of the arc discharge and the glow discharge, a discharge of an ultra-high brightness can be obtained in a stable manner, so that the discharge tube of an ultra-high brightness can be obtained. And besides, electron-emitting substances, vaporized and emitted in a scattered manner from the arc discharge electrode, are captured by the glow discharge electrode, and since the electron-emitting substances thus captured can be again used for the electron emission, there can be obtained the discharge tube of an extremely long service life.

Recently, there has been provided an arc discharge electrode which is formed by mixing an electron-emitting substance, such as barium, lanthanum boride and cesium, with powder of tungsten, and then by press-molding or compacting this mixture together with a lead wire, using a mold, and subsequently by sintering this compact.

SUMMARY OF THE INVENTION

It is an object of this invention to provide a discharge tube which has the above-mentioned sintered arc discharge electrode and a glow discharge electrode and has a long service life.

According to the present invention, there is provided a discharge tube comprising a tube body whose interior defines a discharge space; and a pair of electrode devices mounted within the discharge space in opposed relation to each other, each of the pair of electrode devices comprising an arc discharge electrode and a glow discharge electrode, and an electron-emitting substance which is adapted to be vaporized and emitted in a scattered manner from the arc discharge electrode so as to be captured by the glow discharge electrode;

the improvement wherein the arc discharge electrode is composed of a sintered body containing the electron-emitting substance therein.

In the present invention, the vaporization and emission of the electron-emitting substance from the arc discharge electrode can be reduced, as compared with the conventional discharge tube in which the surface of the arc discharge electrode is coated with such an electron-emitting substance. Therefore, the lifetime of the arc discharge electrode is prolonged, and this further prolongs the service life of the discharge tube.

Further, since the lead wire can be integrally molded in the arc discharge electrode, the electrode device can be directly mounted on the discharge tube, and this facilitates the manufacture of the discharge tube.

DESCRIPTION OF THE PREFERRED EMBODIMENTS

Preferred embodiments of the present invention will now be described with reference to the drawings.

Figure 1:
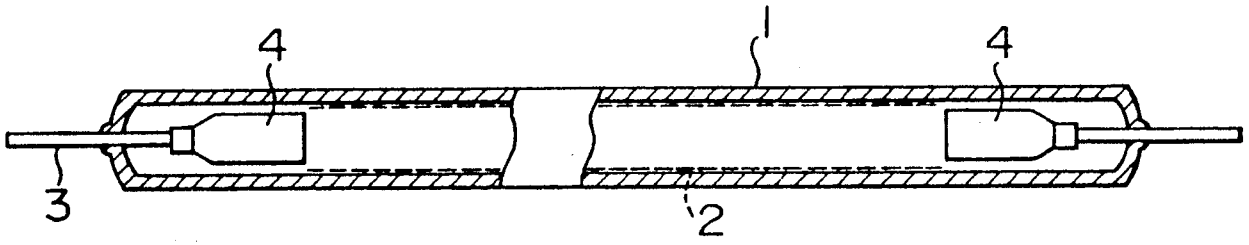
FIG. 1 is a longitudinal cross-sectional view of a first embodiment of a discharge tube of the present invention.

FIG. 1 is a longitudinal cross-sectional view of a discharge tube. This discharge tube comprises a glass tube body 1 whose inner surface is coated with a fluorescent material 2. Two electrode devices 4 are mounted within the tube body 1, and are positioned respectively at the opposite end portions of the tube body 1 by lead wires 3 extending respectively through the opposite end walls of the tube body 1. The electrode devices 4 in a pair are disposed in an opposed relation to each other. A mixture gas of argon and mercury is sealed in the discharge tube for the purpose of discharging.

Figure 2:
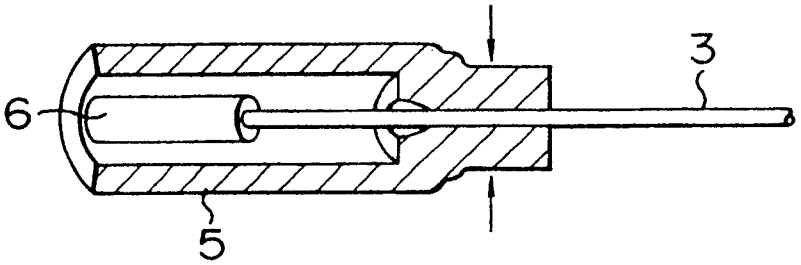
FIG. 2 is a schematic perspective view of an electrode device shown in FIG. 1.

As shown in FIG. 2, each of the electrode devices 4 comprises a generally cup-shaped glow discharge electrode 5 composed of a sintered metal body, and an arc discharge electrode 6 which is composed of a sintered metal body and is received within the glow discharge electrode 5 coaxially therewith. The arc discharge electrode 6 is supported by the lead wire 3 which extends through a through hole, which is extended through the closed end portion of the cup-shaped glow discharge electrode 5, and fixedly secured thereto by pressing or compressing.

Figure 3:
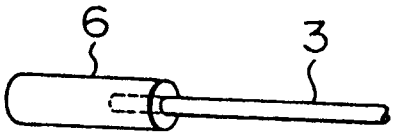
FIG. 3 is a perspective view of a sintered arc discharge electrode shown in FIG. 2.

FIG. 3 is a perspective view of the arc discharge electrode 6. For forming the arc discharge electrode 6, barium is mixed with powder of tungsten, and by the use of a mold, this powder mixture is press-molded or compacted into a cylindrical shape, with one end portion of the lead wire 3 being embedded in one end portion of this cylindrical compact. Then, this cylindrical compact is sintered to provide the arc discharge electrode 6. Cesium, lanthanum boride and other suitable materials may be added to the above mixture.

Figure 4:
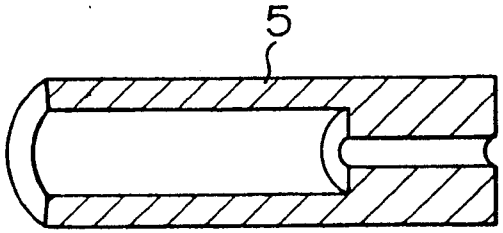
FIG. 4 is a partly-broken, perspective view of a glow discharge electrode shown in FIG. 2.

FIG. 4 shows the glow discharge electrode 5. For forming the glow discharge electrode 5, a mixture of tungsten and nickel is press-molded or compacted into a cup-shape by the use of a mold, and then this compact is sintered to provide this glow discharge electrode 5. The through hole is formed axially through the closed end portion of the cup-shaped glow discharge electrode 5. As will be appreciated from FIG. 2, after the lead wire 3 is passed through this through hole, the closed end portion of the glow discharge electrode 5 is compressed or pressed radially inwardly, so that the arc discharge electrode 6 is held within the cup-shaped glow discharge electrode 5 coaxially therewith. Although the mixture of tungsten and nickel is used here, the nickel may be replaced by aluminum. Also, instead of using the above sintered metal, the glow discharge electrode 5 may be formed from a pipe of aluminum, nickel, iron or any other suitable material; however, in this case, the discharge characteristics are somewhat lowered.

Figure 5:
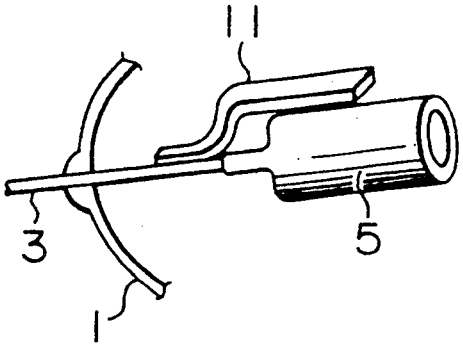
FIG. 5 is a perspective view of a modified glow discharge electrode.

In order to obtain a getter effect (for absorbing gases), zirconium may be added to the above mixture of tungsten and nickel, or the sintered body may be coated with zirconium. Alternatively, as shown in FIG. 5, a getter member 11 may be provided adjacent to the outer periphery of the glow discharge electrode 5. In this case, the rear end portion of the getter member 11 is bent and welded to the lead wire 3 extending through the through hole. Preferably, a zirconium-mercury getter should be used as the getter member 11. If such a getter is used, there is no need to seal mercury in the discharge tube, since mercury is already contained in the getter.

Figure 6:
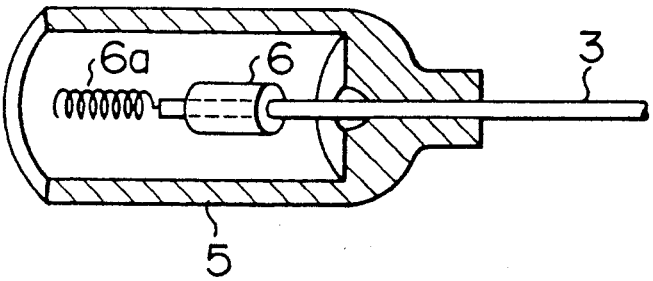
FIG. 6 is a partly-broken, perspective view of a modified electrode device used in the discharge tube of FIG. 1.

FIG. 6 shows a modified form of the above embodiment.

In this embodiment, a filament coil electrode 6*a* is further connected to a distal end of an arc discharge electrode 6 of an electrode device 4. With the sintered arc discharge electrode 6 having no such filament coil electrode 6*a*, it takes 1 to 2 minutes before the normal discharge is obtained after turning on the discharge tube; however, with the construction of FIG. 6, the normal discharge can be obtained in about 10 to 20 seconds after turning on the discharge tube. More specifically, the filament coil electrode 6*a* first begins an arc discharge, and the sintered arc discharge electrode 6 is heated by the heat generated by this arc discharge, so that the normal discharge condition can be soon obtained. And besides, since the discharge of the filament coil electrode 6*a* is added, the brightness is enhanced.

The filament coil electrode 6*a* is formed by coating an active oxide onto the surface of a coil and then by hardening this coil.

The above embodiments are examples of cold-cathode fluorescent discharge tubes. Examples of hot-cathode fluorescent discharge tubes will be described below.

Figure 7:
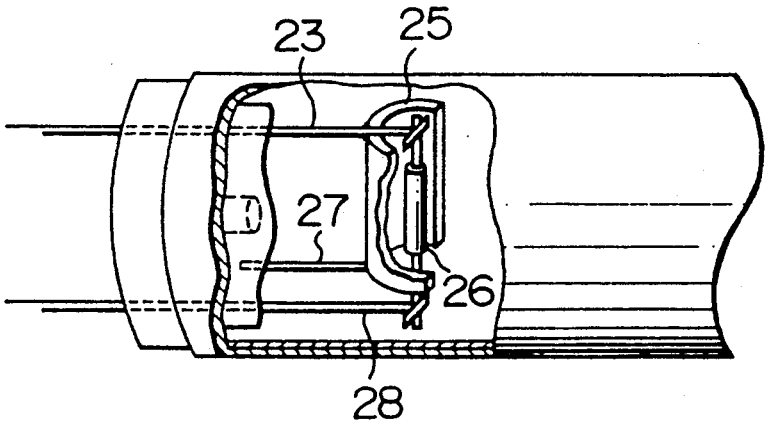
FIG. 7 is a partly-broken, perspective view of one end portion of a second embodiment of a discharge tube of the present invention.

A further embodiment of the invention will now be described with reference to FIG. 7. FIG. 7 shows only one end portion of a discharge tube. A semi-cylindrical glow discharge electrode 25, composed of a sintered body, is disposed within a discharge tube body, and extends perpendicular to the axis of the tube body, with its open side (that is, the concave surface) being directed toward the other end of the discharge tube. The glow discharge electrode 25 is supported by a lead wire 23, extending through the end of the discharge tube, and an anchor 27 extending from the end of the discharge tube. An arc discharge electrode 26, composed of a sintered body containing an electron-emitting substance, is received in the semi-cylindrical glow discharge electrode 25 and extends along the axis thereof. The arc discharge electrode 26 is supported at one end thereof by the above lead wire 23, and is supported at the other end thereof by another lead wire 28 extending through the end of the discharge tube.

EXAMPLE 1

Figure 8:
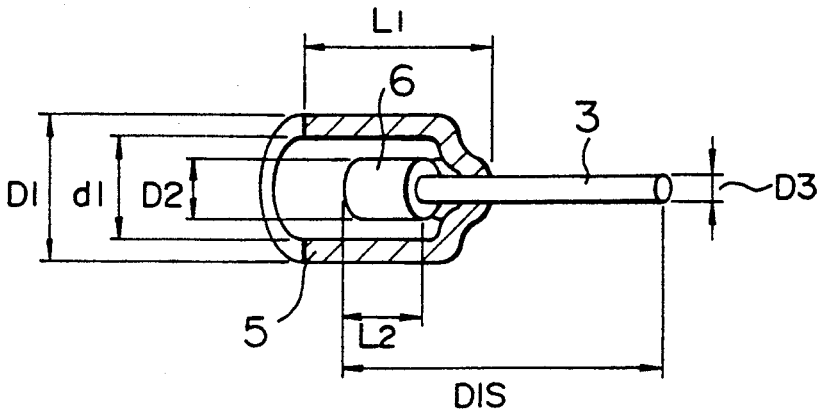
FIG. 8 is a partly-broken, perspective view of an electrode device used in a test.

Results of a test of a discharge tube according to the present invention will be described with reference to FIG. 8. The specifications of this discharge tube are as follows:

Oscillation frequency: 50 KHz
Oscillation voltage: 700 v (effective value)
Sealed gas:
  Argon: 50 torr
  Mercury: 5 mg
Outer diameter of glass tube: 6.5 mm
(thickness: 0.5 mm)
Length of glass tube: 250 mm
Fluorescent material: triple-wavelength fluorescent material (white color)
Atmosphere temperature: 20 deg. C.
Opposed electrodes (see FIG. 8):
  Outer diameter (D1) of glow discharge electrode: 4.5 mm
  Inner diameter (d1) of glow discharge electrode: 3.5 mm
  Overall length (L1) of glow discharge electrode: 4.5 mm (Effective length: 3.5 mm)
  Outer diameter (D2) of arc discharge electrode: 2.5 mm
  Length (L2) of arc discharge electrode: 2.0 mm
  Distance (DIS) between the distal end of arc discharge electrode and the end of the tube: 7.0 mm
  Outer diameter (Ds) of lead wire: 1.5 mm The results of the test are as follows:
Discharge current: 16 mA (effective value)
Brightness of discharge tube: 30,000 nt
Lifetime: 20,000 hr The reason for the achievement of the above ultra-high brightness and ultra-long lifetime will be described. A blackening phenomenon caused by the electron radiating substance which is evaporated by electron and ion impacts develops in the cup-shaped electrode, and this substance still exhibits the function of electron emission. Therefore, the blackening of the glass tube was prevented so that the lifetime of the discharge tube can be prolonged. Also, the glow discharge and the arc discharge occur at the same time, and therefore the ultra-high brightness can be obtained by the synergistic effect of these two discharges.

Figure 9:
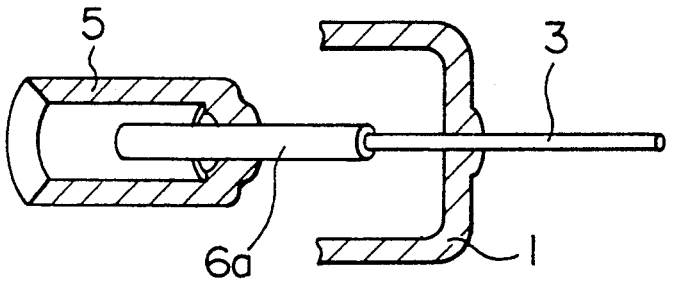
FIGS. 9 and 10 are partly-broken, perspective views of further embodiments of the invention, respectively.
Figure 10:
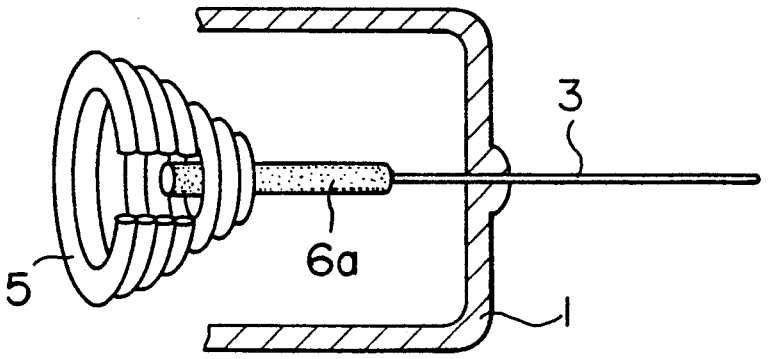

FIGS. 9 and 10 show further embodiments of the invention, respectively.

In each of the above-mentioned embodiments, the arc discharge electrode 6 is received in the cup-shaped glow discharge electrode 5. During the manufacture of the discharge tube, in the evacuation step (final stage) of creating vacuum ($10^{-6}$ to $10^{-8}$) in the discharge tube, in order to prevent a flickering of the emitted light (that is, to stabilize the discharge), the electrode device is heated by a bombarder to 900 to 1,000° C. so as to remove dirt and harmful gases on the surface of the electrode. At this time, the arc discharge electrode 6 is likely to be hindered by the cup-shaped glow discharge electrode 5 from being sufficiently heated. As a result, in some cases, dirt and harmful gases may not be satisfactorily removed from the electrode 6.

The electrode device shown in FIG. 9 is analogous in structure to the electrode device of FIG. 2, but differs therefrom in that an arc discharge electrode 6*a* is projected by a distance of about 2 mm from a rear end of a glow discharge electrode 5. With this arrangement, during the above heating, the heat is propagated from the projected rear end portion of the arc discharge electrode 6*a* toward its distal end received within the cup-shaped glow discharge electrode 5, so that the whole of the arc discharge electrode 6*a* can be sufficiently heated rapidly, thus overcoming the above problem with the manufacture. However, in this case, it is necessary that the amount of emission of electrons from the arc discharge electrode 6*a* should be determined to be sufficient. In this case, it is preferred that a Dumet wire should be used as a lead wire 3.

FIG. 10 shows a modified form of the construction of FIG. 9. In this embodiment, a cup-shaped glow discharge electrode 5 is formed by tightly winding a tungsten wire with a diameter of 0.3 to 0.5 mm into a funnel-like coil-shape. With this arrangement, the thickness of the cup-shaped glow discharge electrode 5 can be reduced.

EXAMPLE 2

A test of a discharge tube as shown in FIG. 1 and incorporating the electrode devices of FIG. 9 was carried out. The specification of this discharge tube are as follows:

Oscillation frequency: 50 KHz
Oscillation voltage: 2,500 v (peak value)
Sealed gas:
  Argon: 70 torr
  Mercury: 5 mg
Outer diameter of glass tube: 5.8 mm
(thickness: 0.5 mm)
Length of glass tube: 260 mm
Fluorescent material: triple-wavelength fluorescent material (white color)
6000 K. (Kelvin)
Atmosphere temperature: 20 deg. C.
Opposed electrodes (see FIG. 8):
  Outer diameter of arc discharge electrode: 1.5 mm
  Length of that portion of arc discharge electrode received in glow discharge electrode: 2.0 mm
  Length of the projected electrode: 2.0 mm The results of the test are as follows:

Discharge current: 14 mA (effective value)
Brightness of discharge tube: 28,000 nt
Life time (reduction of brightness by half): 20,000 hr Also, another test was carried out, using a discharge tube of the same specifications employing the electrode devices of FIG. 10, and similar results were obtained. In this case, the diameter of the coil-shaped tungsten wire was 0.2 mm.

With the above constructions, there can be manufactured the discharge tubes which are high in mass-productivity, and inexpensive, and have good discharge characteristics, and stable in operation.

A further improved effect can be obtained by coating an electron-emitting substance, such as barium, to either the surface of the arc discharge electrode 6*a* or this surface and the inner surface of the glow discharge electrode 5. By doing so, the brightness of the discharge tube is further improved.

This embodiment is suitable for a hot-cathode fluorescent discharge tube.

As described above, in the discharge tube comprising the pair of opposed electrode devices each including the arc discharge electrode and the glow discharge electrode, since the arc discharge electrode composed of the sintered body containing the active oxide is used, the service life of the discharge tube is further prolonged, and the discharge tube is highly resistant to vibration and impact. And besides, since the arc discharge electrode can be molded and sintered integrally with the lead wire, the assembling and manufacture of the discharge tube can be carried out easily.

What is claimed is:

1. A discharge tube comprising a tube body whose interior defines a discharge space; and a pair of electrode devices mounted within said discharge space in opposed relation to each other, each of said pair of electrode devices comprising an arc discharge electrode, a glow discharge electrode and an electron emitting substance for being vaporized and emitted in a scattered manner from said arc discharge electrode so as to be captured by said glow discharge electrode, said arc discharge electrode being composed of a sintered body containing said electron emitting substance therein, and said glow discharge electrode being composed of a sintered body made of tungsten, nickel and zirconium.

2. A discharge tube comprising a tube body whose interior defines a discharge space; and a pair of electrode devices mounted within said discharge space in opposed relation to each other, each of said pair of electrode devices comprising an arc discharge electrode, a glow discharge electrode and an electron emitting substance for being vaporized and emitted in a scattered manner from said arc discharge electrode so as to be captured by said glow discharge electrode, said arc discharge electrode being composed of a sintered body containing said electron emitting substance therein, said glow discharge electrode is composed of a sintered body made of tungsten and one of nickel and aluminum, and a coating of zirconium formed on said sintered body of said glow discharge electrode.

3. A discharge tube according claims 1 or 2, in which a pair of lead wires extend respectively through opposite ends of said tube body, and are integrally molded at their one end respectively in said sintered bodies constituting said arc discharge electrodes of said pair of electrode devices, respectively.

4. A discharge tube according to claims 1 or 2, in which said glow discharge electrode is of a generally cup-shape, and is disposed along the axis of said tube body, said arc discharge electrode being of a cylindrical shape, and said arc discharge electrode being received within said cup-shaped glow discharge electrode generally coaxially therewith.

5. A discharge tube according to claim 4, in which a filament coil electrode is connected to a distal end of said arc discharge electrode.

6. A discharge tube according to claims 1 or 2, in which said glow discharge electrode is of a generally funnel-like coil-shape, and is disposed generally coaxially with said tube body, said arc discharge electrode being of a cylindrical shape, and said arc discharge electrode extending into the interior of said glow discharge electrode generally coaxially therewith in such a manner that one end of said arc discharge electrode remote from said glow discharge electrode is projected from said glow discharge electrode.

7. A discharge tube according to claims 1 or 2, in which said glow discharge electrode is of a generally semi-cylindrical shape, and is disposed generally perpendicular to the axis of said tube body, a concave surface of said semi-cylindrical glow discharge electrode of each of said pair of electrode devices being directed toward the opposite electrode device, said arc discharge electrode being of a cylindrical shape, said arc discharge electrode being received in said semi-cylindrical glow discharge electrode, and extending along the axis of said glow discharge electrode, and a pair of lead wires extending through each of opposite ends of said tube body, and being connected respectively to opposite ends of said arc discharge electrode of each of said pair of electrode devices.

8. A discharge tube according to claims 1 or 2, in which a getter member is disposed adjacent to an outer periphery of said glow discharge electrode.

* * * * *